United States Patent [19]

Gotho et al.

[11] 4,328,731

[45] May 11, 1982

[54] ELECTRONIC TONE GENERATOR

[75] Inventors: Mitsuhiro Gotho; Masayuki Ikeda; Hidetoshi Komatsu; Takahiro Naka, all of Suwa, Japan

[73] Assignee: Kabushiki Kaisha Suwa Seikosha, Tokyo, Japan

[21] Appl. No.: 925,508

[22] Filed: Jul. 17, 1978

[30] Foreign Application Priority Data

Jul. 15, 1977 [JP] Japan ..... 52-85415

[51] Int. Cl.[3] ..... G10H 1/057; G10H 1/12; G10H 7/00

[52] U.S. Cl. ..... 84/1.01; 84/1.03; 84/1.24; 84/1.26; 84/DIG. 9; 84/DIG. 11

[58] Field of Search ..... 84/1.01, 1.03, 1.24, 84/1.26, DIG. 9, DIG. 11

[56] References Cited

U.S. PATENT DOCUMENTS

| | | | |
|---|---|---|---|
| 3,515,792 | 6/1970 | Deutsch | 84/1.24 |
| 3,878,749 | 4/1975 | Woron | 84/1.01 |
| 3,885,489 | 5/1975 | Sasaki | 84/1.01 |
| 3,977,290 | 8/1976 | Sakashita | 84/DIG. 11 |
| 4,014,167 | 3/1977 | Hasegawa et al. | 84/1.03 X |
| 4,055,103 | 10/1977 | Machanian | 84/DIG. 11 |
| 4,074,605 | 2/1978 | Shigeto | 84/DIG. 9 |
| 4,082,027 | 4/1978 | Hiyoshi | 84/1.01 |
| 4,085,645 | 4/1978 | Ryon | 84/DIG. 11 |
| 4,090,349 | 5/1978 | Takase | 84/1.01 X |
| 4,131,049 | 12/1978 | Okumura | 84/1.01 |
| 4,137,810 | 2/1979 | Wheelwright et al. | 84/1.03 |
| 4,138,915 | 2/1979 | Najai | 84/1.01 |

*Primary Examiner*—Stanley J. Witkowski

*Attorney, Agent, or Firm*—Blum, Kaplan, Friedman, Silberman and Beran

[57] ABSTRACT

An electronic tone generator capable of providing improved musical and tone quality by providing a primary melody and a secondary melody such as an accompaniment or the like is provided. The electronic tone generator of the instant invention is characterized by the use of a primary electronic scale generator circuit for producing a primary scale signal representative of a primary melody scale and a secondary electronic scale generator circuit for producing a secondary scale signal that is representative of a secondary melody and that is distinct from the primary scale signal. The primary scale signal and second scale signal are respectively shaped and summed and thereafter applied to an electro-acoustic transducer in order to produce music having a primary melody and secondary melody of considerable musical quality.

26 Claims, 9 Drawing Figures

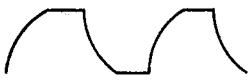
FIG. 3a
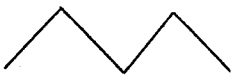
FIG. 3b
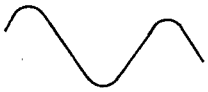
FIG. 3c
FIG. 4a
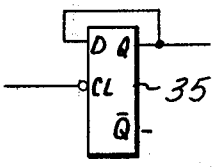
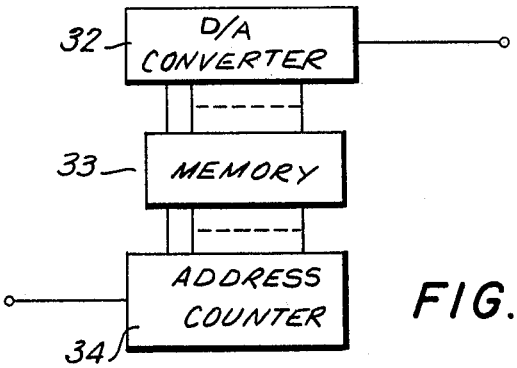
FIG. 4c
FIG. 4b
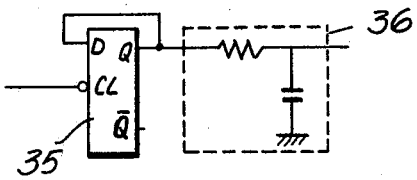
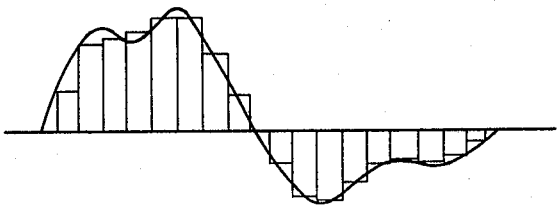
FIG. 4d

ELECTRONIC TONE GENERATOR

BACKGROUND OF THE INVENTION

This invention is directed to an electronic tone generator circuit for producing higher quality music and, in particular, to an electronic tone generator utilizng a primary electronic scale generator circuit and a secondary scale generating circuit for respectively producing scale signals that are distinct with respect to each other in order to provide a primary melody and secondary melody such as an accompaniment in order to improve the quality of the music produced thereby.

Tone generators formed entirely of electronic components have been proposed. It is noted, however, that music produced by available electronic tone generators have a monotone quality and, hence, is inferior in quality to the music produced by mechanical music generators of the type incorporated in a music box. As a result of the inferior musical effects provided by electronic tone generators, the numerous advantages which same provide over conventional music box mechanical tone generators have not as yet been fully appreciated. For example, mechanical tone generators are limited to a single tune, whereas electronic tone generators can be reprogrammed to perform a plurality of tunes. Similarly, electronic tone generators not only permit winding springs to be eliminated but, additionally, the rhythm of the music to be selectively varied. Accordingly, an electronic tone generator capable of producing music that compares in tone quality with mechanical tone generators of the type used in a music box is desired.

SUMMARY OF THE INVENTION

Generally speaking, in accordance with the instant invention, an electronic tone generator for producing a primary melody and secondary melody is provided. The tone generator includes an electro-acoustic transducer and a primary electronic scale generator circuit. The primary electronic scale generator circuit produces a primary scale signal representative of a primary melody scale. A secondary electronic scale generator circuit produces a scale signal that is representative of a secondary melody and that is distinct from the primary scale signal. A first wave shaping circuit is adapted to receive the primary scale signal and produce a primary shaped melody signal. A second wave shaping circuit is adapted to receive the secondary scale signal and produce a secondary shaped secondary melody signal. A mixing circuit is coupled to the first and second wave shaping circuits for summing said primary and secondary melody signals and applying same to the electro-acoustic transducer in order to produce music having a primary melody and a secondary melody.

Envelope forming circuits can be included in the first and/or second wave shaping circuits in order to produce more acoustically comfortable tones. Moreover, supplementary wave shaping circuitry can be provided in the first and second wave shaping circuits in order to produce a rectangular shaped primary melody signal and a non-rectangular secondary melody to thereby provide an accompaniment for the melody produced by the electro-acoustic transducer.

Accordingly, it is an object of the instant invention to produce an electronic tone generator that produces more acoustically pleasing music.

Another object of the instant invention is to provide an electronic tone generator that permits music, comprised of a melody and an accompaniment, to be produced.

Still another object of the instant invention is to provide a tone generator comprised of electrical components that are inexpensive to manufacture and operate in a highly reliable manner.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 3*a*, 3*b* and 3*c* respectively illustrate musical wave signals having less overtone components than a rectangular musical wave;

FIGS. 4*a*, 4*b* and 4*c* respectively illustrate distinct embodiments of the wave shaping circuits; illustrated in FIG. 2; and FIG. 4*d* is a wave diagram illustrating the manner in which a musical wave is digitally synthesized by the wave shaping circuit depicted in FIG. 4*c*.

DETAILED DESCRIPTION OF THE PREFERRED EMBODIMENTS

Figure 1:
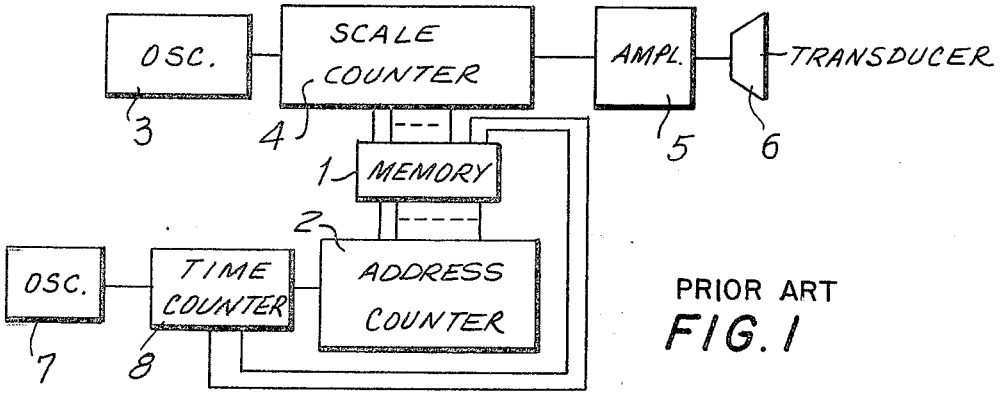
PRIOR ART FIG. 1
FIG. 1 is a block circuit diagram of an electronic tone generator circuit.

Reference is first made to FIG. 1, wherein an electronic tone generator having programmable counters for regenerating scale and time data, in order to produce a melody, is depicted. A memory 1 is adapted to store scale and time information therein, which information is read out in response to an address signal applied thereto by an address counter 2. A programmable scale counter 4 is coupled to the memory 1 and divides pulses produced by a high frequency oscilator circuit 3 in accordance with the division ratio determined by the scale information stored in memory 1. Specifically, the programmable scale counter is comprised of a plurality of series-connected divider stages, which divider stages produce digital signals having a frequency and duration that is controlled by the memory 1. The scale signal, produced by the programmable scale counter 4, is applied to an amplifier 5, which amplifier in turn applies the amplified scale signal to an electro-acoustic transducer 6, such as a loudspeaker or the like. Thus, in response to the scale signal, applied to the amplifier 5, the transducer 6 produces sounds having a tonal quality.

In order to make the tones produced by the transducer 6 comfortable to the ear, the amplifying circuit can be provided with a filter for selectively varying the shape of the scale signals produced by the scale counter. Alternatively, the amplifier can be provided with circuitry for varying the ratios of the scale signals in order to change the envelope of the scale signal.

As aforenoted, the memory 1 applies to the programmable scale counter 4 signals for selecting a specific division ratio representative of a series of ascending or descending musical tones. Additionally, the memory 1 has stored therein time information, for selecting the rhythmical component of the scale signal produced by the programmable scale counter. For this purpose, the memory 1 controls a further programmable time counter 8, which time counter receives high frequency signals from a further oscillator circuit 7. In order to establish proper rhythm, the oscillator circuit 7 produces a signal having a higher frequency than the signal produced by oscillator 3. Preferably the frequency of the signal produced by the oscillator circuit 7 is a multiple of the frequency of the signal produced by oscillator circuit 3. Accordingly, the division ratio of the programmable time counter 8 is varied by the signals applied from the memory 1 to thereby control the address counter 2 and, hence, synchronize the application of the ascending or descending tone signals to the programmable scale counter and thereby add to the scale signal a rhythmical component.

It is noted, however, that the tones produced by the electronic tone generator circuit, illustrated in FIG. 1, have a monotone quality and, hence, the music produced thereby is inferior to that produced by a mechanical tone generator of the type incorporated into a music box. Nevertheless, as is apparent from the electronic circuitry depicted in FIG. 1, among the advantages that inure to an electronic tone generator is the facility with which new music information can be stored into the memory to thereby produce different tunes, changes in rhythm, starting and stopping. As is detailed below, these advantages of electronic tone generators are realized in accordance with the teachings of the instant invention.

Figure 2:
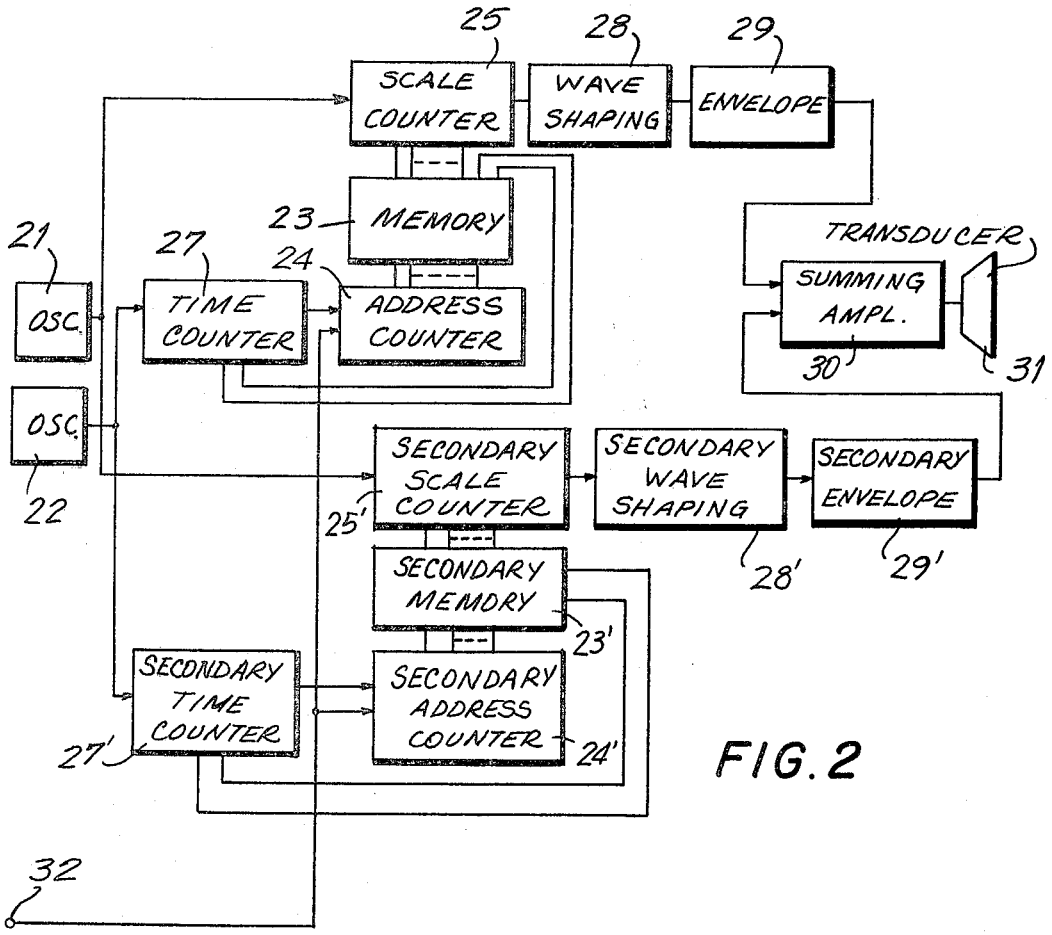
FIG. 2 is a block circuit diagram of an electronic tone generator circuit constructed in accordance with a preferred embodiment of the instant invention.

Reference is now made to FIG. 2, wherein an electronic tone generator circuit, constructed in accordance with the preferred embodiment of the instant invention, is depicted, like labels being utilized to denote like elements discussed above with respect to FIG. 1. A primary electronic scale generating circuit is comprised of oscillator circuit 21, programmable scale counter 25, memory 23, address counter 24 and time counter 27. Each of these circuits operates in the same manner as their counterpart labeled circuits in FIG. 1, in order to produce a primary scale signal respresentative of a primary melody scale.

Additionally, a secondary programmable scale counter 25' is also coupled to oscillator circuit 21 in order to produce a secondary scale signal representative of a secondary melody. To this end, a secondary memory 23' is coupled to the secondary programmable counter 25' and applies thereto secondary scale information in response to the secondary address counter 24' applying an address signal thereto. The oscillator circuit 22, in addition to controlling the time counter 27 of the primary electronic scale generating circuit, also controls the timing and, hence, rhythm of the secondary electronic scale generator circuit by applying a high frequency signal to the secondary time counter 27' that is of the same frequency as the signal applied to the primary time counter 27. Moreover, it is noted that the timing signal, produced by the oscillator circuit 22, is of a considerably higher frequency than the signal produced by the oscillator circuit 21. Accordingly, the secondary scale generating circuit is adapted to produce, at the output of programmable scale counter 25, a secondary scale signal that is rhythmically and musically (ascending or descending series of musical tones) distinct from the primary scale signals produced by the scale counter 25.

Coupled to the first scale counter 25 of the primary tone generating circuit is a wave shaping circuit 28 for shaping the primary scale signal produced by the scale counter 25. Similarly, secondary wave shaping circuit 28' is coupled to the secondary scale counter 25' of the secondary electronic scale generating circuit for shaping the scale signal produced thereby. The shaped signals respectively produced by the wave shapers 28 and 28' are then applied through envelope circuits 29 and 29', respectively, to thereby apply acoustic envelopes to the respective shaped signals applied thereto. Finally, the shaped signals produced by envelope circuits 29 and 29' are applied to a mixing and summing amplifier circuit 30, which circuit sums and amplifies the respective signals and properly attenuates same so that a composite signal can be applied to the electro-acoustic transducer 31 and be transmitted as a musical sound. In order to effect synchronizing of the primary and secondary address counters 24 and 24', an input signal 32 is coupled thereto.

If the outputs from the address counters 24 and 24' are the same, the programmable scale counters 25 and 25' will produce a graduated series of musical tones having the same height since the programmable scale counters will have the same division ratios. Moveover, each successive musical tone will also be the same since the time counters will identically sequence the respective scale counters as each successive note is produced. However, if the frequency with which the contents of the address counters 24 and 24' are varied by effecting a time delay therebetween, a distinct primary melody and a further distinct secondary melody, such as an accompaniment, will be produced by the respective circuits. In order to assure that this effect is obtained, the oscillator circuit 22 is selected to produce signals having a period representative of the shortest time in any tune, to wit, a quaver. Accordingly, the frequency of the oscillator circuit 22 is selected to produce a pulse having a period equal to a quaver. Thereafter, the memory circuits 23 and 23' store melody data that will selectively vary the division ratio of the respective programmable scale counters and time counters so that the divided pulses are divided by one-half in the case of a crotchet (quarter note) or into quarters in the case of a minim (half note). The musical tones are then divided one by one and applied to the address counters 24 and 24' as inputs thereof, and the velocities with which the address counters are to be sequenced are selectively varied. However, it is noted that the respective primary and secondary circuits both commonly utilize the same oscillator which further effects synchronization between the primary scale generating circuit and the secondary scale generating circuit. Moreover, the primary memory circuit stores the data, representative of a main melody, whereas the secondary memory circuit can store data, representative of accompaniments. As is explained in greater detail below, by this arrangement, the scale signal, produced by the primary electronic scale generating means and the secondary scale signal, produced by the secondary electronic scale generating means, produce independent melodies which can be summed to thereby improve the quality of the tone of the sound produced by the transducer 31.

As aforenoted, the main melody and an accompaniment must be synchronized with respect to each other. To this end, a method of synchronizing the primary and secondary electronic scale generating circuit is necessary. A binary "0" address is, therefore, applied to the respective memory circuits 23 and 23', which circuits, in turn, reset the address counters 24 and 24' at the same time. Accordingly, a binary "0" address is used as a control pulse to synchronizing the system since no tone will be generated while the address counters are reset.

It is noted that the envelope circuits 29 and 29' are not essential but are particularly suitable for generating comfortable tone quality and represent one manner in which the amplifying ratio can be smoothed into a comfortable envelope prior to the signals being applied to the electro-acoustic transducer.

It is noted, however, that the wave shaping circuits 28 and 28' are significant in improving the quality of the music produced by the electronic tone generator circuit, depicted in FIG. 2. If the scale counters 25 produce rectangular shaped waves and, additionally, high overtone components are desired in either the primary melody or the secondary melody, the respective wave shaping circuits can be eliminated. However, in order to utilize the secondary melody as an accompaniment or the like, a scale signal, having less overtone components than a rectangular wave, is needed. Moreover, since rectangular waves have higher tones when compared with waves having less overtone components, the instant invention particularly provides for producing a rectangular wave signal to provide a primary melody and a wave having less overtone components to produce a secondary melody such as an accompaniment. To this end, reference is made to FIGS. 3*a*, 3*b* and 3*c* wherein waves having less overtone components than a rectangular wave are illustrated.

In an endeavor to obtain shaped wave signals of the type discussed above, detailed embodiments representative of the wave shaping circuits 28 and 28' are illustrated in FIGS. 4*a* and 4*b*, detailed above. Specifically, a D-type flip-flop of the type depicted in FIG. 4*a*, will produce a rectangular wave. Accordingly, if the primary scale signal, produced by the scale counter 25 is to be maintained as a rectangular wave, the wave shaping circuit 28 can be comprised of a D-type flip-flop. The flip-flop is necessary since a signal produced by the programmable scale counter 25 will not be suitable for producing a melodious tone and, instead, the flip-flops 35 will divide the signal produced by the scale counter 25 by one-half to produce a rectangular wave having a one-half duty cycle. This half duty cycle rectangular wave is then used to produce the main melody. Similarly, by disposing a filter circuit 36 at the output of the flip-flop 35, in the manner illustrated in FIG. 4*b*, the half duty cycle rectangular wave is changed to thereby eliminate the high tones therefrom, and hence produce a signal that is suitable for producing a secondary accompaniment melody of the type depicted in FIG. 3*a*.

Reference is also made to FIGS. 4*c* and 4*d* wherein a wave shaping circuit, for dividing the scale signal at specific intervals, is provided. To this end, the data signals stored in the memory 33 are digitally stored at peak values and read out of the memory into the digital-to-analog converter 32, which converter converts same into an analog signal. The frequency with which the signals are read from the memory to the digital-to-analog converter 32 is determined by the address counter 34, using pulses produced by the programmable counters. By this arrangement, it is possible to vary the frequency of the address counter and produce a signal having any particular wave from desired (sine, triangular, etc.). Thus, by utilizing a wave shaping circuit, of the type depicted in FIG. 4*c*, sounds of the type made by different musical instruments, representative of a main melody and an accompaniment melody, can be respectively produced by the first and second electronic scale generating circuits and then summed in the manner illustrated in FIG. 2 to thereby provide an improved music quality.

Although the description of the preferred embodiment of the instant invention is limited to a primary electronic scale generating circuit and a secondary electronic scale generating circuit, the larger the number of scale generating circuits, the greater the improvement in the quality of the music produced. However, by adding a secondary melody, such as an accompaniment, a dramatic improvement in the overall tone quality of the music is realized.

As aforenoted, with the exception of the electro-acoustic transducer, each of the circuit elements of an electronic tone generator, constructed in accordance with the instant invention, can be formed of C-MOS integrated circuit elements. This permits a tone generator, of the type detailed herein, to be readily combined with other IC circuits formed of MOS elements that perform different functions, such as electronic wristwatch movements or the like. Moreover, the electric tone generating circuit of the instant invention can be integrated on the same circuit chip at the same time as an electronic timepiece or other electronic instrument.

It is further noted that the preferred embodiment of the instant invention illustrates the use of two oscillator circuits, which is particularly suitable for utilizing an electric tone generator with an electronic wristwatch. However, if the tone generator is utilized without an electronic wristwatch movement, the respective oscillators (21 and 22) can be replaced with a single oscillator with the divider circuitry effecting the necessary changes in frequency to obtain the necessary control of the primary and secondary programmable scale counters and primary and secondary programmable time counters.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic tone generator for automatically reproducing musical melodies using stored data, comprising:

at least one signal generating oscillating circuit;

a memory circuit for storing data for controlling note duration;

at least one note producing circuit;

circuit means for controlling the duration of each individual note produced by said at least one note producing circuit, said circuit means for controlling duration operating in response to said data stored in said memory circuit, said circuit means for controlling note duration including a programmable counter dividing down signals from said at least one signal-generating oscillator circuit, the division ratio of said programmable counter being variable in response to said data stored in said memory;

an address counter receiving the output of said programmable counter and outputting a signal to said memory circuit, said signal causing the memory address to advance, whereby data for the next successive note is input to said programmable counter from said memory;

and an electro acoustic transducer receiving the output of said at least one note producing circuit and outputting audible notes to reproduce music.

2. An electronic tone generator as claimed in claim 1, and further comprising amplifier means receiving the output of said at least one note producing circuit and delivering an amplified signal to said electroacoustic transducer.

3. An electronic tone generator for automatically reproducing musical melodies from stored data, comprising:

at least one signal-generating oscillator circuit;

a memory circuit for storing frequency data of notes for reproduction and time data for each note for controlling note duration and musical tempo;

at least one note producing circuit, each at least one note producing circuit including a first programmable counter circuit for variably dividing pulses outputted by said at least one signal-generating oscillator circuit to reproduce in sequence different notes of selected frequencies and selected durations in response to sequential reading of said data in said memory circuit, the note output of each note producing circuit being independent of the note output of any other note producing circuit;

an electro-acoustic transducer receiving the output of said at least one note producing circuit and outputting audible notes in sequence to reproduce music from each said at least one note producing circuit.

4. An electronic tone generator as claimed in claim 3, and further comprising a wave shaping circuit in each of said at least one note producing circuits, said wave shaping circuit receiving the signal output of said associated note producing circuit and being adapted to modify said signal output to provide periodic waves having a selected wave form.

5. An electronic tone generator as claimed in claim 3, and further including in each note producing circuit circuit means for controlling the duration of each note, said circuit means for controlling duration operating in response to said time data stored in said memory circuit.

6. An electronic tone generator as claimed in claim 4, wherein said selected wave form is rectangular.

7. An electronic tone generator as claimed in claim 4, wherein said selected wave form is sinusoidal.

8. An electronic tone generator as claimed in claim 3, and further comprising amplifier means receiving the output of said at least one note producing circuit and delivering an amplified signal to said electroacoustic transducer.

9. An electronic tone generator as claimed in claim 4, and further comprising amplifier means receiving the output of said shaping circuit and delivering an amplified signal to said electroacoustic transducer.

10. An electronic tone generator as claimed in claim 4, wherein said selected wave form is sawtooth triangular.

11. An electronic tone generator as claimed in claim 4, wherein said wave shaping circuit superimposes an amplitude modulating envelope on the signal from said first programmable counter.

12. An electronic tone generator for automatically reproducing musical melodies from stored data, comprising:

at least one signal-generating oscillator circuit;

a memory circuit for storing frequency data of notes for reproduction and time data for controlling note duration and musical tempo;

at least one note producing circuit, each at least one note producing circuit including a first programmable counter circuit for variably dividing pulses outputted by said signal-generating oscillator circuit to reproduce in sequence different notes of selected frequencies in response to said data in said memory circuit, the note output of each said note producing circuit being independent of the note output of any other note producing circuit;

a wave shaping circuit in each of said at least one note producing circuits, said wave shaping circuit receiving the signal output of said associated note producing circuit and being adapted to modify said signal output to provide periodic waves having a selected wave form;

wave shaping in a first note producing circuit is adapted to produce a primary melody signal having a shape that is distinct from the shape of a secondary melody signal produced by the wave shaping circuit in a second note producing circuit;

an electro-acoustic transducer receiving the output of said shaping circuit and outputting audible notes in sequence to reproduce music.

13. An electronic tone generator as claimed in claim 12, wherein said first wave shaping means includes envelope means for modulating the acoustical envelope of said primary melody signal.

14. An electronic tone generator as claimed in claim 12, wherein said second wave shaping means includes an acoustical envelope means for modulating the acoustical envelope of said secondary melody signal.

15. An electronic tone generator as claimed in claim 12, wherein said second wave shaping means is adapted to produce a secondary melody signal that is substantially reduced in overtone quality with respect to said primary melody signal produced by said first wave shaping means.

16. An electronic tone generator as claimed in claim 12, wherein said first wave shaping means is a rectangular wave shaping circuit means for producing a rectangular primary melody signal.

17. An electronic tone generator as claimed in claim 16, wherein said rectangular wave shaping circuit means is a D-type flip-flop.

18. An electronic tone generator as claimed in claim 15, wherein said second wave shaping means is a non-rectangular wave shaping circuit means for producing a secondary wave shaping signal that is absent a rectangular shape.

19. An electronic tone generator as claimed in claim 12, wherein said second wave shaping means includes output circuit means for producing a secondary melody signal that is absent a rectangular shape.

20. An electronic tone generator as claimed in claim 19, wherein said output circuit means is a low pass filter.

21. An electronic tone generator as claimed in claim 12, wherein said wave shaping means are adapted to produce signals having a non-rectangular wave form substantially similar to wave form of signals produced by distinct musical instruments.

22. An electronic tone generator as claimed in claim 20, wherein at least one of said first and second wave shaping circuits is comprised of an address counter, a memory and a digital-to-analog converter for producing a melody signal having a predetermined shape.

23. An electronic tone generator as claimed in claim 12, and further comprising amplifier means receiving the output of said shaping circuit and delivering an amplified signal to said electroacoustic transducer.

24. An electronic tone generator for automatically reproducing musical melodies from stored data, comprising:

at least one signal-generating oscillator circuit;

a memory circuit for storing frequency data of notes for reproduction and time data for controlling note duration and musical tempo;

at least one note producing circuit, each at least one note producing circuit including a first programmable counter circuit for variably dividing pulses outputted by said signal-generating oscillator circuit to reproduce in sequence different notes of selected frequencies and selected durations in response to said frequency data in said memory circuit, the note output of each said at least one note producing circuit being independent of the note output of any other note producing circuit;

means for controlling the duration of each note, said circuit means for controlling duration operating in response to said time data stored in said memory circuit, said circuit means for controlling note duration includes in each said note producing circuit:

a second programmable counter dividing down said signals from said at least one signal-generating oscillator circuit, the division ratio of said second programmable counter being variable in response to said time data stored in said memory; an address counter receiving the output of said second programmable counter and outputting a signal to said memory circuit, said signal causing the memory address to advance, whereby data for the next successive note is input to said first and second programmable counters from said memory;

an electro-acoustic transducer receiving the output of said at least one note producing circuit and outputting audible notes in sequence to reproduce music.

25. An electronic tone generator as claimed in claim 24, wherein said signal from said oscillator circuit has a period equal to the duration of the shortest note in the melody to be played by said tone generator.

26. An electronic tone generator as claimed in claim 24, and further comprising amplifier means receiving the output of said at least one note producing circuit and delivering an amplified signal to said electroacoustic transducer.

* * * * *

UNITED STATES PATENT AND TRADEMARK OFFICE

CERTIFICATE OF CORRECTION

PATENT NO. : 4,328,731

DATED : May 11, 1982

INVENTOR(S) : MITSUHIRO GOTO et al.

It is certified that error appears in the above—identified patent and that said Letters Patent is hereby corrected as shown below:

In the drawings,

Fig. 1, delete the label "PRIOR ART".

Signed and Sealed this

*Tenth* Day of *August 1982*

[SEAL]

*Attest:*

GERALD J. MOSSINGHOFF

*Attesting Officer*

*Commissioner of Patents and Trademarks*